United States Patent [19]

Schuh et al.

[11] Patent Number: 4,601,353

[45] Date of Patent: Jul. 22, 1986

[54] METHOD FOR DRILLING DRAINHOLES WITHIN PRODUCING ZONE

[75] Inventors: Frank J. Schuh, Plano; John H. Striegler, Richardson, both of Tex.

[73] Assignee: Atlantic Richfield Company, Los Angeles, Calif.

[21] Appl. No.: 658,244

[22] Filed: Oct. 5, 1984

[51] Int. Cl.[4] ..... E21B 47/00

[52] U.S. Cl. ..... 175/41; 175/45; 175/62

[58] Field of Search ..... 175/26, 41, 45, 62; 250/266

[56] References Cited

U.S. PATENT DOCUMENTS 2,336,338 12/1943 Zublin ..... 255/16

3,398,804 8/1968 Holbert ..... 175/61

3,823,787 7/1974 Haworth et al. ..... 175/41 X 4,262,964 4/1981 Ingle et al. ..... 175/41 X

*Primary Examiner*—Stuart S. Levy

*Assistant Examiner*—David Werner

*Attorney, Agent, or Firm*—Albert C. Metrailer

[57] ABSTRACT

A method for drilling a drainhole through a subsurface formation without intersecting upper or lower boundaries thereof in which a directionally sensitive measurement while drilling device carried on the drainhole string is used to measure a formation property which indicates proximity to a formation boundary. Upon detection of such proximity, the direction of drainhole drilling is changed to direct the drainhole away from the detected boundary.

5 Claims, 2 Drawing Figures

METHOD FOR DRILLING DRAINHOLES WITHIN PRODUCING ZONE

BACKGROUND OF THE INVENTION

The present invention relates to the drilling of drainholes in subsurface formations and more particularly to the use of a measurement while drilling device to allow correction of drainhole direction to avoid crossing boundaries of a selected subsurface formation.

The drilling of lateral bores from a main vertical borehole is a well developed art. For example, U.S. Pat. No. 2,336,338 issued to Zublin on Dec. 7, 1943 and U.S. Pat. No. 3,398,804 issued to Holbert on Aug. 27, 1968 each teach various equipment and methods for drilling a curved bore away from an existing vertical borehole. Both of these patents are incorporated by reference for all purposes. The Zublin patent teaches the use of a pre-curved guide to begin the curved portion of the horizontal bore. After a sufficient bore angle has been achieved, Zublin teaches the use of a straight guide to continue the horizontal bore in a straight direction away from the main vertical bore.

In practice, considerable problems have been encountered in attempting to control the direction of lateral or horizontal bores extending from vertical wells. Such problems have often limited the extent of the horizontal bore to several hundred feet from the vertical borehole. In many cases it would be desirable to extent such lateral bores to 1000 feet or more from the vertical bore.

The use of well survey tools is a well-known technique for determining the actual locations of a bore. However this technique is time consuming and expensive since it usually requires that the drill string be pulled from the borehole during the surveying process. When it is determined that the horizontal bore is not proceeding in the desired direction, techniques are know for curving the bore to correct for the errors. For example, a mud driven hydraulic motor may be used on the drill string to drive the drill bit. This motor and bit combination can easily be arranged to drill in a continuous curve. When a straight hole is desired the entire drill string may be slowly rotated during the drilling operation to counteract the tendency of the bit to drill the curved hole. When correction is needed, the drill string may be oriented appropriately so that the motor and bit are allowed to drill a curved section of hole to compensate for directional errors detected by a survey device.

In addition to the time and expense involved in the process of repeating surveys and corrections, another problem is encountered with such a process especially where very long lateral holes are desired. The precise upper and lower boundaries of subsurface formations are often not precisely known especially at any reasonable distance from the borehole. Hydrocarbon bearing formations are normally neither perfectly horizontal nor perfectly flat. Thus the upper and lower boundaries of the formation will generally slant or dip with respect to true horizontal and will have localized nonuniformities. As a result, even if the well surveying techniques were perfect, it would not be possible to determine precisely where the lateral bore should be placed to keep it within the producing zone of interest.

SUMMARY OF THE INVENTION

Accordingly, an object of the present invention is to provide an improved method for controlling the direction of a lateral borehole extending a great distance from a vertical borehole into a hydrocarbon bearing zone so that it stays within the zone of interest and does not penetrate upper or lower boundaries thereof.

According to the present invention, a lateral borehole is drilled using a drill string which includes a directionally sensitive measurement while drilling device which measures at least one formation property and, upon occurence of a change in such measured property, changing the direction of drilling so that the lateral hole turns away from the structure which is the source of such detected change.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
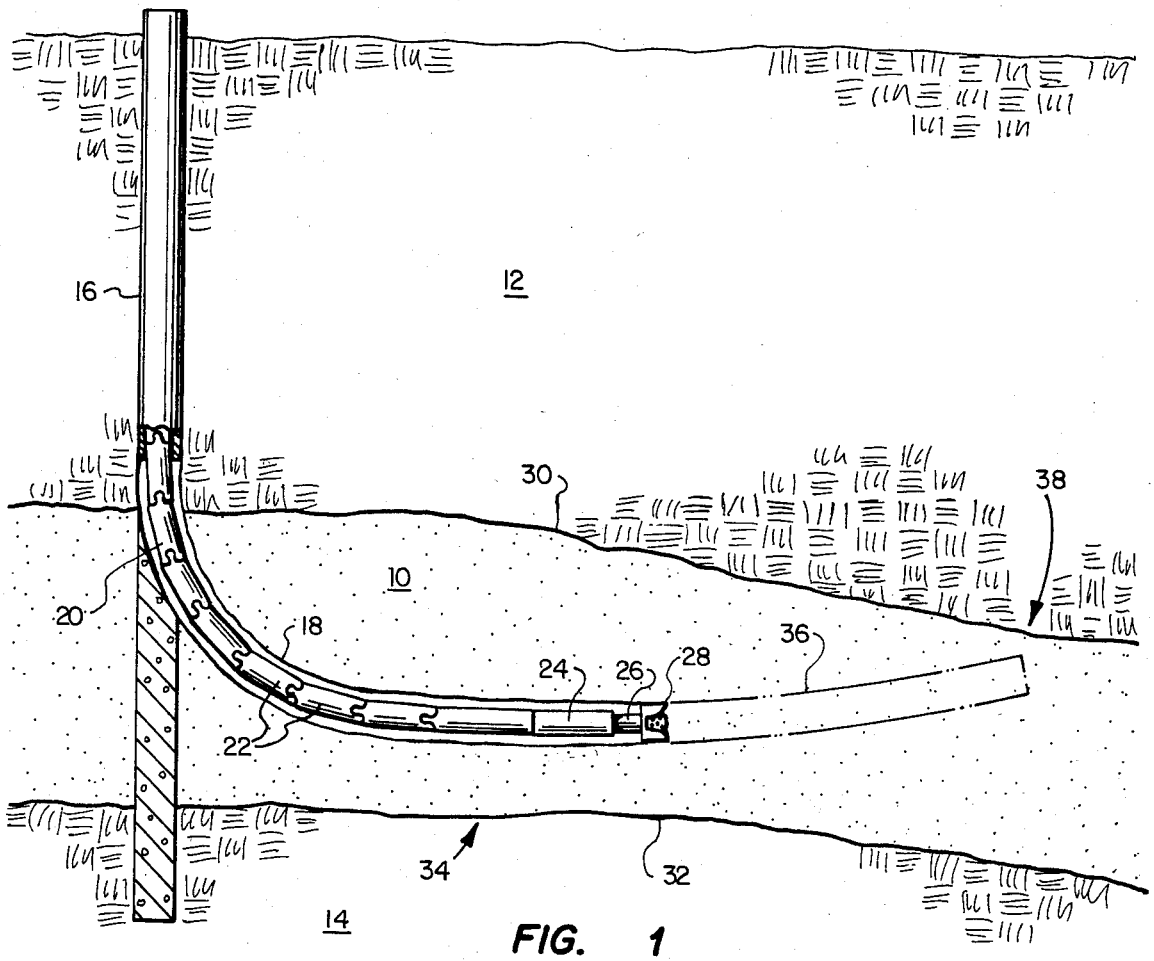
FIG. 1 is a cross-sectional illustration of a subsurface formation in which a lateral hole is being drilled by the method of the present invention.

With reference now to FIG. 1, there is provided a cross-sectional illustration of several subsurface formations including an oil bearing sand 10 sandwiched between an upper shale zone 12 and a lower shale zone 14. A vertical wellbore 16 has been drilled from the surface of the earth to and through the oil bearing zone 10. A lateral borehole 18 has been started from vertical bore 16 within the oil sand 10. The methods of starting such a lateral borehole are well-known in the art as illustrated by the above referenced Zublin and Holbert patents. A drill string 20 extends from the surface of the earth through wellbore 16 and into the lateral bore 18. In this embodiment, the string 20 includes segmented drillpipe sections 22 made according to the above referenced Holbert patent. These segmented sections 22 allow rotation of drill string 20 through curved portions of lateral bore 18. Near the lower end of drill string 20, there is provided a MWD (measurement while drilling) device 24 for measuring at least one formation property during the drilling operation. Connected to the MWD device 24 is a mud driven hydraulic drill motor 26 which in turn supports and drives a drill bit 28.

The conventional MWD system which was used in the preferred embodiment imposes certain restrictions on the curved portion of the lateral bore 18. In particular, curvature should not exceed 6° per hundred feet of bore or it will not be possible to run the conventional tool assemblies into the lateral bore. As a result, the methods of Zublin and Holbert which allow much greater curvature rates cannot be used to full advantage. More conventional slant drilling techniques which can provide curvature rates of 2° to 6° per hundred feet of bore without the complex highly flexible sections of Zublin and Holbert can therefore be used and will normally be preferred so long as conventional MWD systems are used. However, development of improved logging devices which can be run in drainholes with high curvature rates is anticipated. Such development will allow the benefits of the present invention to be realized in formations where the high curvature rates are required or at least preferred.

Lateral borehole 18 is often called a horizontal borehole to distinguish it from the conventional vertical wellbore 16. The term "lateral" is also often used for the same purpose. Both of these terms suggest that the non-vertical borehole is essentially horizontal. In the present invention the lateral section 18 will be referred to primarily as a "drainhole" to distinguish it from the vertical bore 16 without suggesting that it must be truly horizontal. As illustrated in FIG. 1, the oil sand 10 is not horizontal. Both the upper boundary 30 and the lower boundary 32 slope downward to the right in FIG. 1. The primary purpose of the drainhole 18 is to provide improved communication between vertical bore 16 and the bulk of the oil sand 10. This can be achieved by drilling drainhole 18 as far as possible into the oil sand 10 and away from bore 16. Since there is no desire to achieve communication with the shale zones 12 and 14, it is preferred that drainhole 18 never cross either of the boundaries 30 or 32. Thus, drainhole 18 should travel out into zone 10 essentially parallel to the upper and lower boundaries 30 and 32 and about half way between them. The vertical depths to boundaries 30 and 32 at borehole 16 can be measured by conventional logging techniques. However since these boundaries slope or dip, a perfectly horizontal borehole extending from bore 16 would eventually intersect either the upper or lower boundaries.

The method of the present invention primarily involves detection of proximity to the boundaries 30 or 32 and correction of the trajectory or path of drainhole 18 preferrably before the boundary is intersected. In this way, prior knowledge of the shape and location of boundaries 30 and 32 is not necessary.

In the preferred embodiment, MWD device 24 is a gamma ray device commonly used for detecting changes in lithology during drilling operations. Such devices generally "look" in all directions about the borehole. However in the present invention, device 24 has been modified by providing a lead shield covering at least one half, and preferably three-fourths, of its circumference so that it sees primarily one side of the borehole. The lead shield is not totally effective in stopping gamma rays but provides sufficient blocking to give the tool a directional response. In this way, the gamma ray device can distinguish between different rock types existing on opposite sides of drainhole 18. In addition, the tool 24 contains a conventional sensor, part of the MWD package, which indicates its orientation relative to vertical, that is the upper side of borehole.

Figure 2:
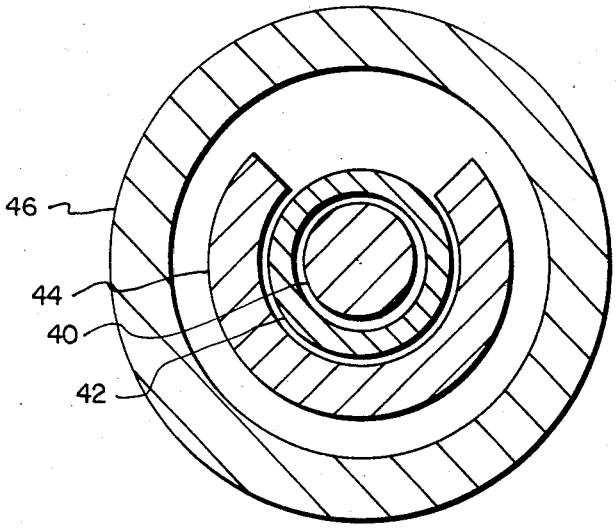
FIG. 2 is a cross-sectional illustration of a portion of a directional gamma ray logging device.

FIG. 2 provides a cross-sectional illustration of device 24 taken through the gamma ray detection tube 40. The detection tube 40 is positioned at the center of the device and is protected by a beryllium copper sleeve 42. A half inch thick lead shield 44, with a 90° window, is carried on sleeve 42. This directional detector assembly is carried in a one inch thick stainless steel collar 46 which forms the outer housing of the MWD device 24 and has an outer diameter of 6.25 inch. With the exception of the lead shield, device 24 is a commercially available MWD device manufactured by Gearhart Industries, Inc. of Fort Worth, Tex. This device includes a magnetometer and, as indicated above, an inclinometer which indicates tool orientation relative to vertical. The tool further includes a mud pulse telemetry system which allows all measured data to be transmitted through the drilling mud column to receiving equipment at the surface.

As is well-known in the well logging and drilling arts, shale such as zones 12 and 14 generally emits higher levels of gamma rays than sand such as found in the oil bearing sand 10. Therefore the gamma ray indication provided by device 24 will increase significantly as it approaches either of the shale zones 12 or 14. Since the lead shield allows some gamma radiation to pass, the increase in detected level should occur even if the shield is positioned between tube 40 and the shale zone being approached.

As illustrated in FIG. 1, the drainhole 18 was started from vertical bore 16 at about the mid-point of oil sand 10. As it curved downward and away from bore 16, it approached the lower boundary 32 at point 34. At this point, the device 24 came close enough to boundary 32 to detect gamma rays emitted from the shale zone 14. As a result, a noticeable increase in gamma ray reading would be detected and transmitted to the surface. This increased signal level would indicate that drainhole 18 is approaching an interface. However since gamma ray detectors generally require a signal integration period of about one minute it would not necessarily indicate whether boundary 30 or 32 is closest. In the preferred embodiment, drilling would cease for a sufficient time to allow determination of whether it is the upper boundary 30 or the lower boundary 32 which is being approached. This determination is made by slowly turning drill string 20 to orient the device 24 in several different directions relative to vertical and holding it in those positions for a sufficient time to obtain an accurate gamma ray reading. For a generally horizontal oil sand 10, two readings should be sufficient. That is, the device 24 would be oriented to obtain gamma ray readings from vertically above and then vertically below drainhole 18. At location 34 in FIG. 1, the gamma ray reading from below should be significantly higher than that obtained from above. This will clearly indicate that drainhole 18 is approaching the lower boundary 32 and that it should therefore be directed upwards to avoid intersection of boundary 32.

As discussed above, drill bit 28 is driven by hydraulicly powered drill motor 26 to provide the primary drilling force. Means must be provided for re-directing the drill string to avoid the undesired intersections with the boundaries. In the preferred embodiment, motor 26 and bit 28 are oriented so that they tend to drill a curved borehole. When the drainhole 18 has been turned to substantially horizontal position and it is desired to drill straight ahead through formation 10, the entire drill string 20 is slowly rotated so that there is no net curvature to the drainhole being drilled. When proximity to the lower boundary 32 is detected, the drill string 20 may then be stopped in an appropriate position so that continued drilling will cause drainhole 18 to climb vertically away from lower boundary 32 as indicated by the dashed line extension 36 of drainhole 18. Rotation of drill string 20 may be recommenced to determine when the drainhole 18 has been moved sufficient far from lower boundary 32 so that it is no longer detectable. Continued rotation of drill string 20 would then cause the extension 36 of drainhole 18 to be substantially straight. The process would be repeated at point 38 when drainhole 18 begins to approach the upper boundary 30 of the oil sand 10. By repeating the process the drainhole 18 may be repetitively redirected to avoid intersection with the upper and lower boundaries of the oil producing zone. It is anticipated that this process will allow drilling of drainholes to distances approaching 2000 feet from a vertical bore 16 without having to withdraw the drill string 20 for the purpose of running well surveys.

As indicated above, gamma ray detecting tools generally require a significant period of time, for example a matter of several minutes, to obtain an accurate reading. It is for this reason that in the preferred embodiment, drilling must be stopped momentarily while a determination of direction of the nearest boundary is made. The gamma ray reading obtained while drill string 20 is rotating will simply be an average of readings taken in all directions about the borehole and will not indicate direction. It is anticipated that the detector 24 will detect gamma rays from shale zones 12 and 14 only when it has approached within about two to three feet of the respective shale zone. The normal configuration of bit, drill motor and logging tool normally places the detector 24 thirty to forty feet behind the bit itself. All of these factors make it difficult to actually avoid crossing the boundaries 30 and 32. However the present method will provide the means to properly redirect the drainhole back into the producing zone 10 after a boundary is crossed.

Other directional sensing devices may be substituted for device 24 and it is anticipated that certain devices may provide better control or improved results. For example it is know that radar type devices can be used to transmit directional microwave energy into rock formation and that the reflection and absorption characteristics of the formation can be measured and can indicate lithology and/or fluid content of the various zones. In addition, it is believed that these devices may provide useful information at distances of ten to fifty feet or more. With such devices, proximity to an upper or lower boundary may be detected from a greater distance so that trajectory in drainhole 18 can be more easily controlled. In addition, it may be possible to make an actual determination of distance to a boundary and with this information to cause the drainhole 18 to travel essentially parallel to and at a fixed distance from one of the boundaries.

While the present invention has been illustrated and described with respect to particular apparatus and methods of operation, it is apparent that various modifications and changes can be made therein within the scope of the present invention as defined by the appended claims.

What is claimed is:

1. A method for drilling a drainhole within a preselected subsurface zone comprising:

using a directionally sensitive measurement while drilling device carried on a drainhole drill string near a drill bit to measure at least one formation property while drilling a drainhole, stopping drilling at such time as a change in the formation property is detected, rotating the drill string to orient the measurement device in a plurality of known angular positions and measuring said property in each of said positions to determine the direction from the borehole of the detected property change, and continuing drilling of said drainhole while adjusting the angle of drilling to direct said drainhole away from the direction of the detected property change.

2. A method according to claim 1 wherein said measurement while drilling device is a gamma ray logging device, said device including a gamma ray blocking shield over at least half its measuring circumference.

3. A method according to claim 2 wherein said gamma ray device further includes means for detecting and providing an indication of device orientation relative to the higher side of the borehole.

4. A method according to claim 1 wherein said drill string includes a hydraulicly driven drill motor driving said drill bit.

5. A method according to claim 4 wherein said drill string further includes means for causing said drill motor and bit to drill a curved hole and said method of drilling said drainhole includes the steps of continuously rotating said drill string when an essentially straight drainhole is desired and stopping the direction of the drill string at a preselected angular orientation when a curved drainhole is desired.

* * * * *